United States Patent [19]

Sumner

[11] 3,950,901

[45] Apr. 20, 1976

[54] DOMICAL STRUCTURE WITH NOVEL BEAM INTERLOCKING CONNECTIONS

[76] Inventor: John S. Sumner, 728 N. Sawtelle, Tucson, Ariz. 85716

[22] Filed: Nov. 4, 1974

[21] Appl. No.: 520,480

[52] U.S. Cl. ..... 52/80; 52/86

[51] Int. Cl.[2] ..... E04B 1/32

[58] Field of Search ..... 52/80, 81, 86, DIG. 10, 52/223 R; D16/1 E

[56] References Cited

UNITED STATES PATENTS

| | | | |
|---|---|---|---|
| 2,545,556 | 3/1951 | Pont | 52/81 |
| 2,705,928 | 4/1955 | Pont | 52/80 |
| 3,280,518 | 10/1966 | White, Jr. | 52/80 |
| 3,417,520 | 12/1968 | Fink | 52/80 |
| 3,439,460 | 4/1969 | Allen | 52/81 |
| 3,581,451 | 6/1971 | Birkemeier | 52/80 X |
| 3,635,509 | 1/1972 | Birkemeier | 52/81 X |
| 3,751,862 | 8/1973 | Linecker | 52/80 X |
| 3,757,478 | 9/1973 | Pryor | 52/80 |
| 3,802,132 | 4/1974 | Sumner | 52/80 |

FOREIGN PATENTS OR APPLICATIONS

| | | | |
|---|---|---|---|
| 1,454,527 | 8/1966 | France | 52/80 |
| 516,495 | 6/1953 | Belgium | 52/223 R |
| 578,285 | 8/1958 | Italy | 52/80 |

*Primary Examiner*—Ernest R. Purser
*Assistant Examiner*—Leslie A. Braun
*Attorney, Agent, or Firm*—Warren F. B. Lindsley

[57] ABSTRACT

This disclosure describes an improved prefabricated domical structure employing connected arches and beams having an interlocking truss-type configuration. Tensional rods secure the footings of the primary arches of the structure. The skeletal structure can either be covered with a draped, initially flexible sheating material which acts in tension between the arches, or by a curved surface shell which adds overall strength to the entire structure.

6 Claims, 22 Drawing Figures

12
12A
14
15
16
16A
17A
20
25
26
27
28
31
32
33
34
35
36
37
38
41
42
43

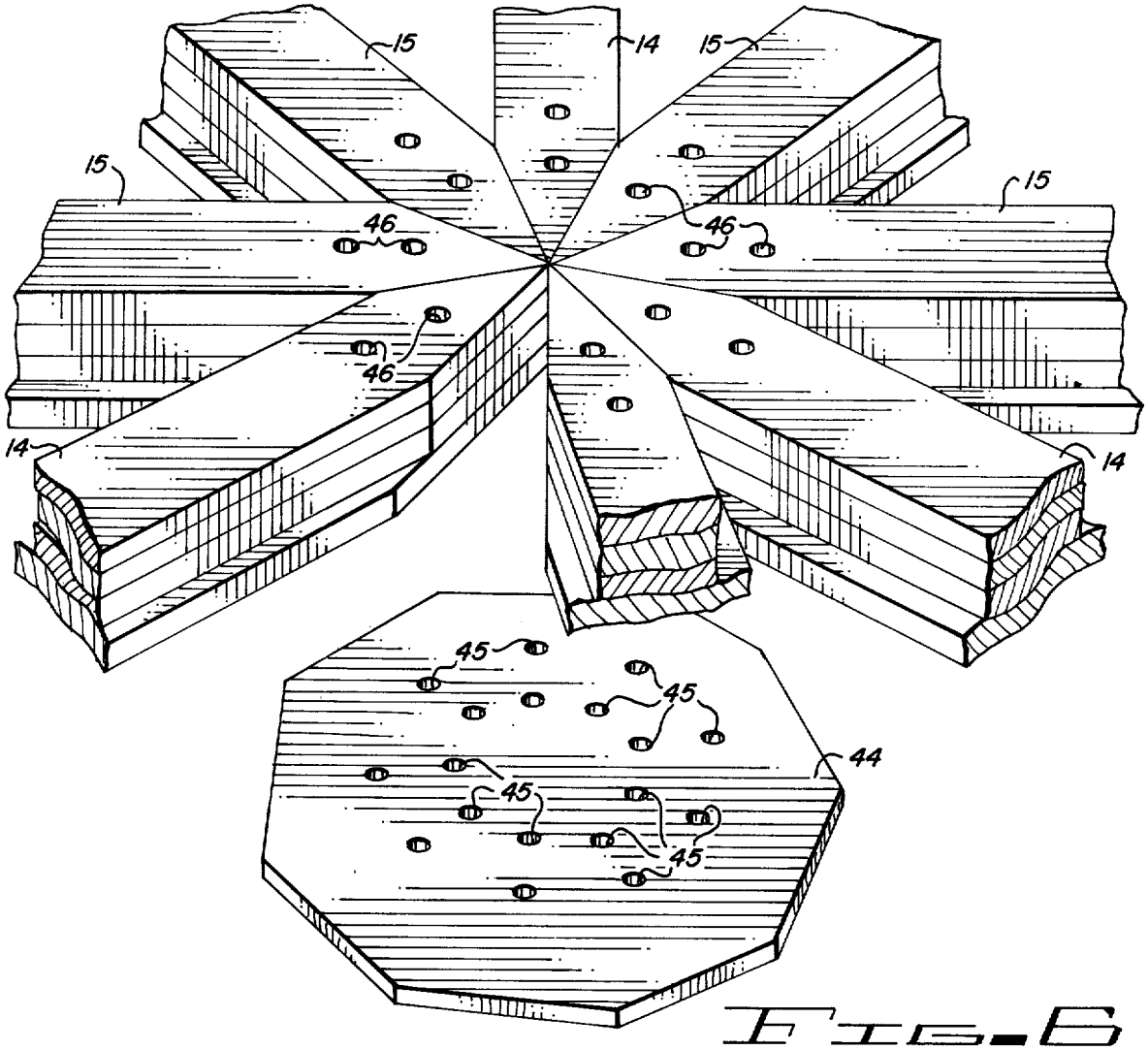
FIG-6
FIG-7
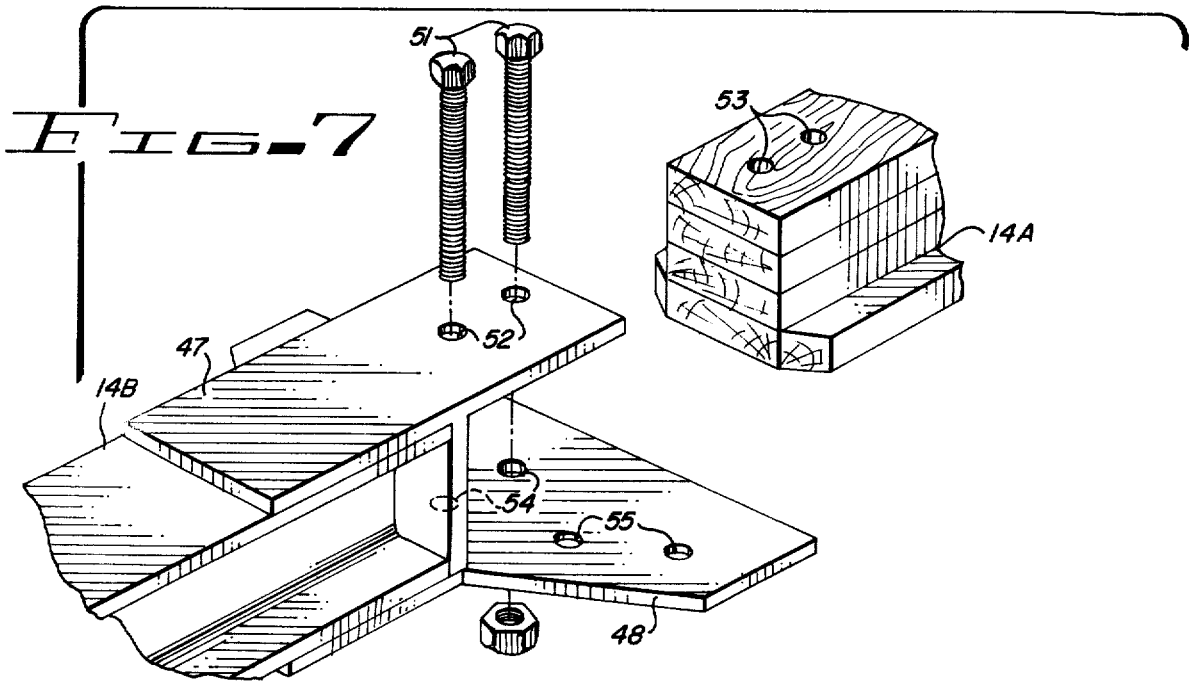

DOMICAL STRUCTURE WITH NOVEL BEAM INTERLOCKING CONNECTIONS

BACKGROUND OF THE INVENTION

This invention relates to the construction of domical structures and more particularly to a simple and more secure assembly and erection of the framework of such a structure using laminated and/or solid beams with interfitting connections to ensure strong joints of perfect fit and maximum carrying capacities. The connections between the beams of the structure make maximum utilization of the actual stresses acting between the beams to assist in holding them together, thereby minimizing use of metal fastening plates, bolts and the like.

FIELD OF THE INVENTION

This invention is particularly directed to the constructional featues of domical structures wherein the joint configuration of, for example, laminated wooden beams assists in the interlocking of the beams by making abutting joints without the need for complex connections and with a minimum of fasteners to hold the arches and beams together.

DESCRIPTION OF THE PRIOR ART

It is well known that domical buildings are more efficient than conventional rectangular structures and enclose a greater amount of space for the same amount of material used. Domes also have the highest strength per weight of any natural or man-made structure. In addition, they are the most stable building enclosure devised since force applied at any point can be absorbed proportionally by all frame members.

However, domical structures have not gained wide acceptance in spite of these many advantages. One of the reasons for the lack of acceptance is the difficulty encountered in fabricating and erecting such structures. Most are not easily assembled in the field and the beam members used have been difficult to form and install.

In the past, beams supporting domical structures have been fastened together by means of metallic plates, bolts, pegs, screws and nails which fasteners must also provide the necessary joint strength for such structures because conventional joints between adjoining beams have been inherently weak.

U.S. Pat. No. 3,802,132 granted Apr. 2, 1974 describes a domical structure which substantially overcomes the difficulties associated with the prior art through the use of specially contoured arches which simplify the assembly and reduce the need for special fasteners. There is still a need, however, for further improvements in the structure.

SUMMARY OF THE INVENTION

In accordance with the invention claimed, an improved domical structure is disclosed which overcomes many of the difficulties encountered in the forming and erecting of such structures, and provides a means for stengthening their foundational supports. The claimed configuration provides a strong, low cost, easy to erect and efficient domical structure for use, inter alia, for domestic, commercial and military purposes.

This invention employs a superior method of abutting adjoining beams to form simple self-locking joints, taking advantage of triangularly and/or rectangularly shaped beams which interlock at their joints in such a manner that the actual stresses acting between the beams assist in holding them together. The claimed structure minimizes the use of and dependency on fastening devices.

It is, therefore, one of the principal objects of this invention to provide a domical structure employing an interlocking truss-type pattern of laminated wood or metal arcuate beam members.

Another object of this invention is to provide a domical structure wherein the joints between arches and beam members are adapted to interlock without mortise-and-tenon cuts therein.

Another object of this invention is to provide a domical structure wherein the interconnecting members are assisted by their joint configuration, through gravity, to remain in position.

Another object of this invention is to provide a domical structure which embraces all of the advantages of great strength, minimum amount of materials, low cost, and efficiency, yet is simple to construct and erect.

Another object of this invention is to provide a simple and effective means for assuring the stability of the foundational supports of such domical structures.

Another object of this invention is to provide means for sectionalizing the arches employed in the structure so as to facilitate shipping and handling.

Yet another object of this invention is to provide an inexpensive and effective roof covering for such improved domical structures. This roof may either consist of a draped, initially flexible material acting in tension, or an outwardly convex surface shell which bears a considerable portion of the structural loads.

These and other objects and advantages of this invention will become more apparent as the description proceeds and the features of novelty which characterize this invention will be pointed out with particularity in the claims annexed to and forming part of this specification.

BRIEF DESCRIPTION OF THE DRAWINGS

The present invention may be more readily described by reference to the accompanying drawings, of which:

FIG. 6 is a detailed view of the converging primary and secondary arches at the top of the structure shown along with the flat steel plate which is used for securing the arches together;

FIG. 7 is a detailed view of the ends of two sections of a primary arch with the special bracket used for coupling them together;

DESCRIPTION OF THE PREFERRED EMBODIMENT

Figure 1:
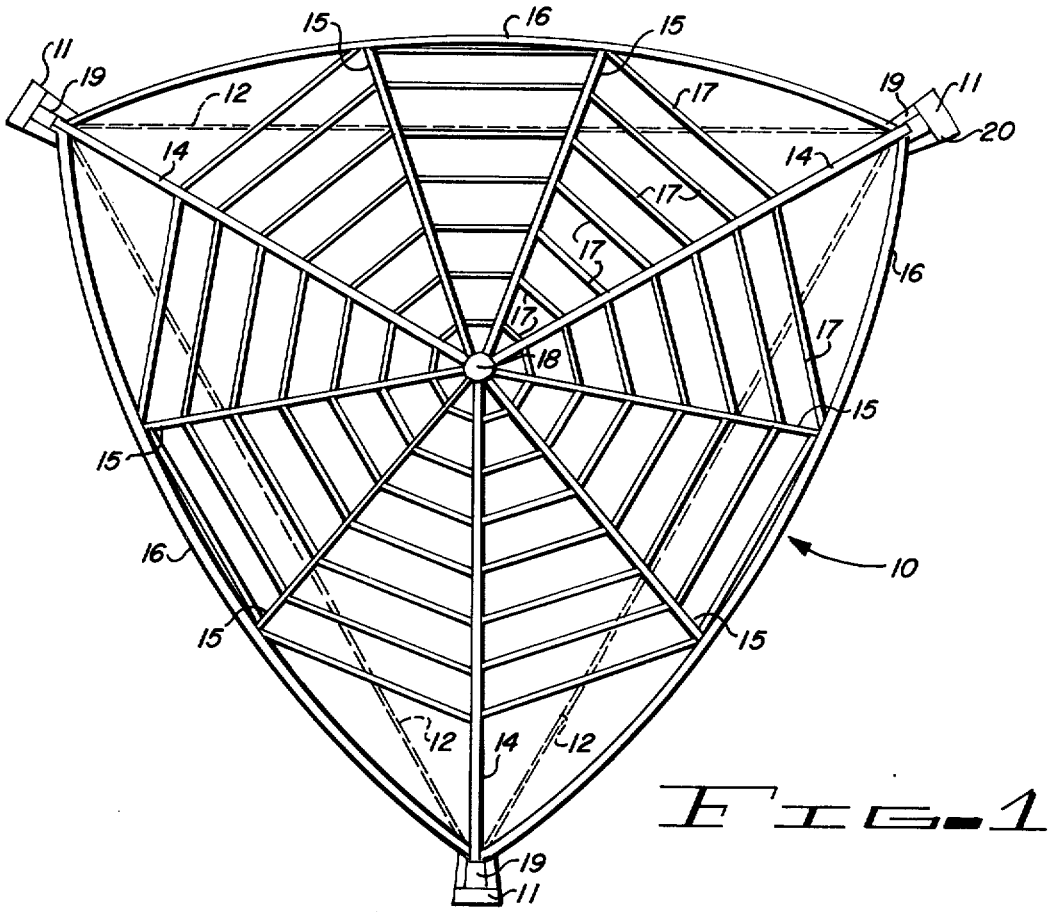
FIG. 1 is a top plan view of the framework of an improved domical structure.
Figure 2:
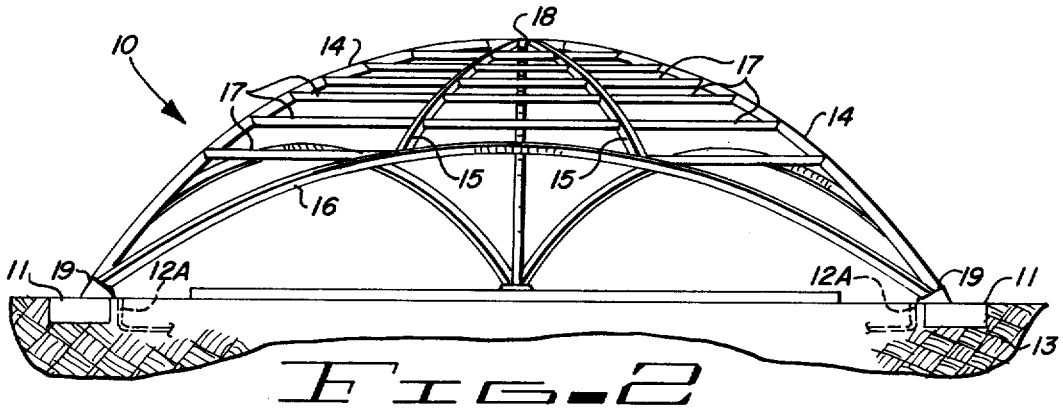
FIG. 2 is a side view of the structure shown in FIG. 1.
Figure 3:
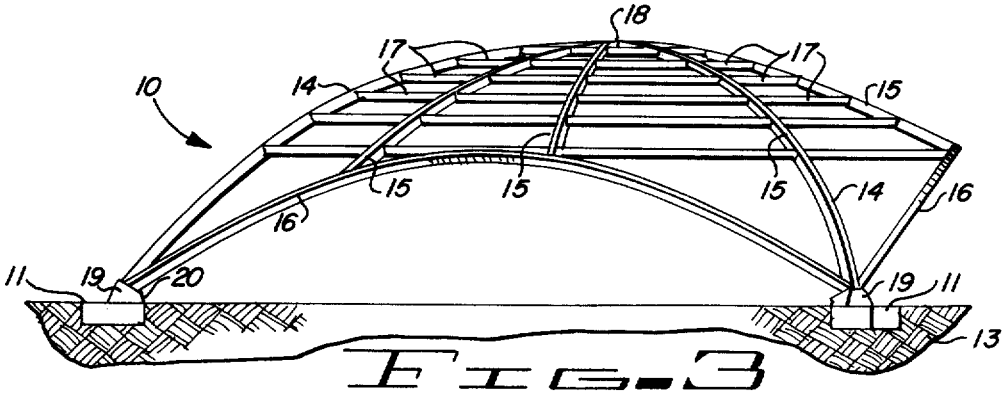
FIG. 3 is a second side view of the structure shown in FIG. 1.

Referring more particularly to the drawings by characters of reference, FIGS. 1–3 disclose a framework for a domical structure 10 having a base or mounting pad 11 for each of the corners of the domical structure, the bases 11 being prevented from spreading apart by interconnecting underground tensional bars 12 running between adjacent bases 11.

Base 11 is typically a flat reinforced concrete pad extending some distance above the surface of the ground 13 and extending in colder climates well below the frost line.

The framework of the domical structure 10 as shown clearly in FIGS. 1–3 comprises primary arches 14, secondary arches 15, edge arches 16, and tertiary beams 17. in the embodiment shown in the drawing there are three primary arches 14 and six secondary arches 15, the primary and secondary arches being arranged about the partial spherical contour of the domical structure 10 as great circles converging at the top center 18 of domical structure 10 in a manner similar to the arrangement of the longitudinal lines drawn on a globe of the earth.

The three primary arches are equally spaced from each other approximately 120° with two secondary arches lying between adjacent primary arches, again uniformly spaced so that between adjacent arches, primary or secondary, there is an angular displacement of about 40°. The three approximately equally spaced primary arches rest at their lower ends on the three bases 11 while the secondary arches terminate well above the ground where they intersect the edge arch.

The edge arch also lies in the spherical surface of domical structure 10 and it passes through two adjacent bases 11 and rises to a height at its center more than half the height of the center 18 above the support of structure 10. Two edge arches thus converge with one primary arch at each of the three corners 19 where the primary and edge arches are secured to bases 11 by means of special support brackets 20 shown more clearly in FIGS. 4 and 5.

The tertiary beams 17 are arranged between adjacent primary and secondary arches completing a triangular truss pattern. In the embodiment shown in FIGS. 1–3 there are seven tertiary beams 17 between each set of adjacent primary or secondary arches, 14 or 15, the inner tertiary beams 17 being spaced equidistant from the center 18 of structure 10.

The strength of the domical structure 10 is inherent in its spherical contour by virtue of which all of the arches, primary, secondary and edge arches, are in compression, the total weight of the structure thus having the effect of forcing most of the joints or points of intersection between arches into closer contact with each other.

While these same forces would tend to drive the bases 11 outwardly, such undesired displacement is effectively countered and prevented by the provision of the tensional rods 12. The subsurface tensional rods 12 can be ordinary steel reinforcing bars with a turned-up hook 12A at each end which is cast into the concrete base 11. The three rods 12 thus lie in the form of an equilateral triangle holding the three bases 11 securely at the corners of the triangle, the tension in the rods 12 thus counteracting the total outwardly component of compression exerted through the arches by the weight of the structure 10. The tension rods could just as easily be a radial pattern meeting below the floor below the center of the dome. As shown, these rods can be used for laying out and fixing the relative position of the rods or support piers of the domical structure.

In contrast to the prior art disclosed in the above identified patent, the supporting surfaces of each of the support brackets 20 is perpendicular to the line of thrust of the supported primary arch 14; a rigid and stable mounting of the structure being thereby afforded.

Although the embodiment shown in the drawing indicates a structure 10 having only three corners 19 supported by three bases 11, similar structures having more than three corners are contemplated and such similar structures fall within the spirit and scope of this invention.

As taught in the above identified patent, the use of inverted triangular or I-shaped cross-sectional beams for the arches aids in the simplification and reduction of the necessary hardware for securing the elements of the structure in position.

Figures 4, 5:
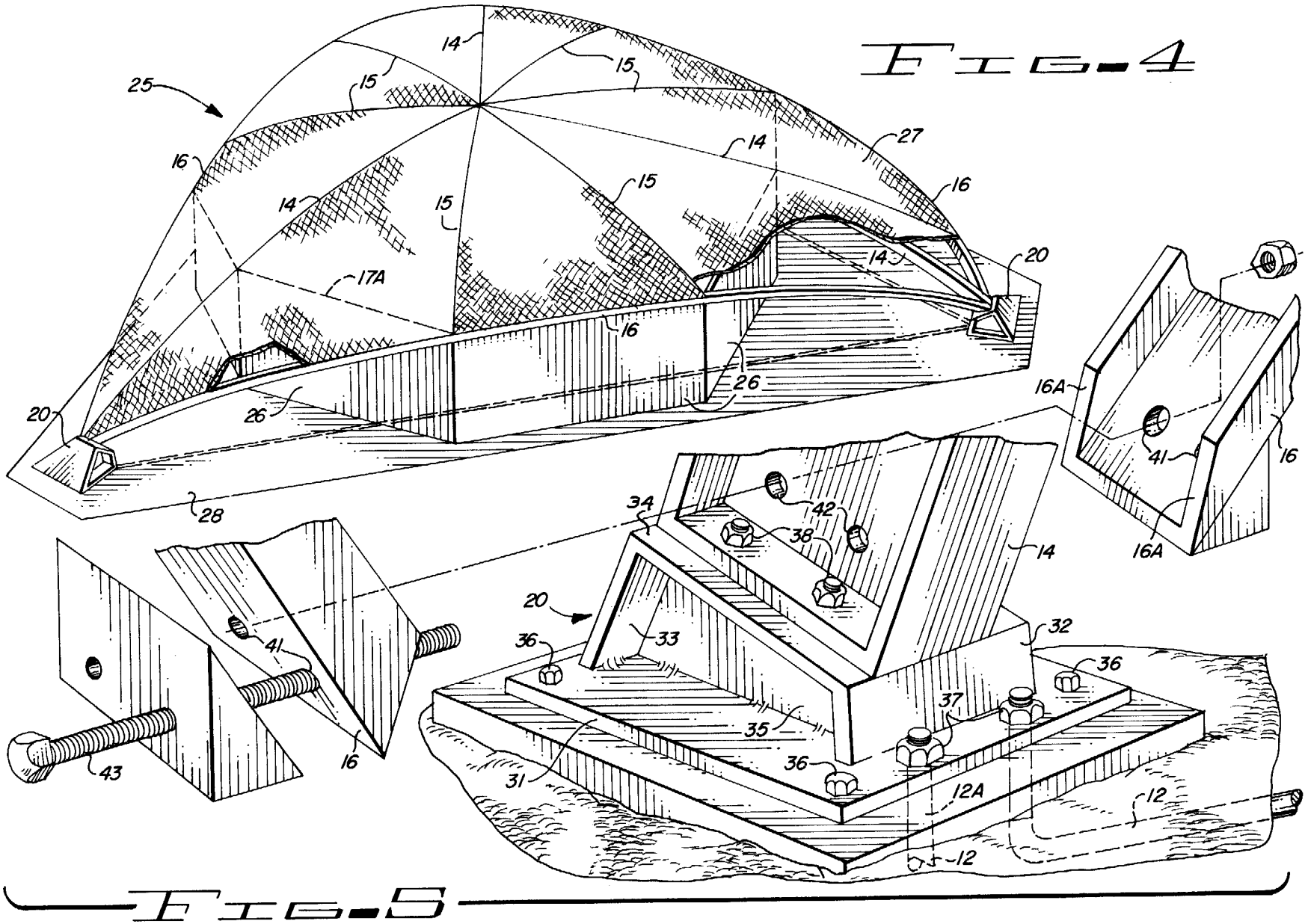
FIG. 4 is a perspective view of a more nearly completed domical structure utilizing the structure of FIGS. 1–3 as its structural framework.
FIG. 5 is a detailed perspective view of a support bracket with the end of a primary arch attached and with the means indicated for securing thereto the ends of the edge arches.

A more nearly completed building 25 utilizing the structure 10 as a framework is shown in FIG. 4 wherein vertical walls 26 have been added along with a roof covering 27 and a ground or floor surface 28.

The walls 26 are installed below the lowermost and outermost tertiary beams 17A, there being a total of nine such walls in the form of an equilateral nine-sided figure. The walls 26 need not be load-bearing and numerous materials and construction methods and variations are thus possible. The walls could, for example, be entirely constructed of glass.

The roof 27 may be applied, if desired, using an initial sheathing of tongue-and-groove boards, plywood, or composition board with the usual covering of insulation, tar paper, shingles, etc. This sheating material is initially flat before application, but becomes curved with the contour of the dome so that the sheating acts like a domical shell, which adds strength to the overall structure.

An alternate and novel roofing approach also incorporated as a feature of this invention involves the use of woven glass fibers, metal mesh, or a similar flexible base material which is laid directly over the arches, stretched taut and secured in place. A semi-liquid cement, capable of hardening, is then applied to the woven material. In this alternate roof construction the draped roof material is in tension, thus it is possible to eliminate the tertiary beams entirely, thereby realizing an additional significant reduction in cost.

As suggested in FIG. 4, the floor surface 28 may be extended beyond the walls 26 to include an area embracing the support brackets 20. Because the floor itself need not support any part of the weight of the structure 10, the construction of the floor surface 28 is not critical and may be inexpensively accomplished.

Details involving the special corner support bracket 20 are shown in FIG. 5, the bracket 20 comprising a flat rectangular base plate 31, rectangular forward and rear plates 32 and 33 rising upwardly and sloping inwardly, an inclined bearing surface 34 and vertical reinforcing ribs 35 between forward and rear plates 32 and 33 and between base plate 31 and the under face of surface 34. All of these parts, 31–35, are of heavy gage steel and they are welded or cast together to form a strong and rigid structure. Holes are drilled in the four corners of the base plate 31 to receive the anchor bolts 36 which are cast into base 11. At the inward edge of plate 31 two additional holes are drilled to receive the bent-up hooks 12A of tension rods 12. Hooks 12A are threaded and secured to plate 31 by means of hex nuts 37.

The lower end of the primary arch 14 is secured to surface 34 by means of bolts 38.

The surface 34 extends beyond arch 14 on both sides to provide a bearing surface for the lower ends of adjoining edge arches 16, the ends 16A of which are tapered to mate with the vertical sides of primary arch 14. Holes 41 in the ends of the side arches 16 and mating holes 42 in arch 14 permit edge arches to be secured in position by means of bolts 43.

As indicated earlier in the description, the inclined surface 34 of bracket 20 allows support of the primary arches by means of a surface which is perpendicular to the line of thrust through arch 14. The mechanical and structural advantage afforded by this arrangement is that is simplifies the means for securing the ends of the arch 14 with a minimum of additional hardware.

FIG. 6 illustrates a very simple and effective means for securing together the upper ends of the primary and secondary arches 14 and 15 at the center 18 of domical structure 10, the means comprising a simple, nine-sided steel plate 44 with a pair of holes 45 drilled to mate with a pair of holes 46 in each of the nine converging arches 14, 15. The arches are, of course, secured to plate 44 by means of steel bolts through holes 45 and 46.

Because the finished total lengths of the primary arches 14 may be too great for convenience in handling and shipping, it is useful to be able to fabricate and ship these arches in sections. Furthermore, it may be desirable to utilize different materials for the primary arches 14 as, for example, curved I-beam or laminated wooden beams.

A convenient means for joining the upper section 14A of primary arch to the lower section 14B of the primary arch in such a construction is shown in FIG. 7 wherein a flat plate 47 is fastened to section 14B at its upper end extending several inches beyond the edge of section 14B. A similarly extending plate 48 is fastened to the under surface of section 14B, the plate 48, however, being extended outwardly on both sides.

When section 14A is to be joined to section 14B, the end of section 14A end butts against the end of section 14B where it is secured by means of bolts 51 which are passed through aligned holes 52 in plate 47, holes 53 in section 14A and holes 54 in plate 48. Additional holes 55 in the extended edges of plate 48 are provided for the securing of tertiary beams to plate 48.

The simple means shown for coupling sections 14A and 14B together as shown in FIG. 7 is adequate and workable by virtue of the novel configuration of domical structure 10 with its balance loading, primarily compression in the arches 14, and because of the lateral support given the arch 14 by tertiary beams 17 and edge arches 16.

An important advantage of the domical structure 10 and the simple means described for securing together its various parts is the lack of difficulty involved in its assembly.

The bases 11 and interconnecting tension rods 12 are first installed as a very simple but stable foundation. Support brackets 20 are then installed.

The primary and secondary arches 14 and 15 are next arranged on the ground between the bases 11 and are loosely secured at the point of convergence to plate 44.

A tripod and a block and tackle or a hoist are then used to raise the centers of the arches until the lower ends of arches 14 may be secured to brackets 20. The inner ends of the secondary arches 15 are then lifted to the center plate and loosely bolted.

Edge arches 16 are then raised into position where they are secured by attachment to the lower ends of secondary arches 15.

The framework of domical structure 10 is then completed by addition of tertiary beams 17.

Walls and roof may then be added as described earlier.

The improvements here provided to the basic domical structure enhance both the strength and the ease of assembly of the structure claimed.

Figure 8:
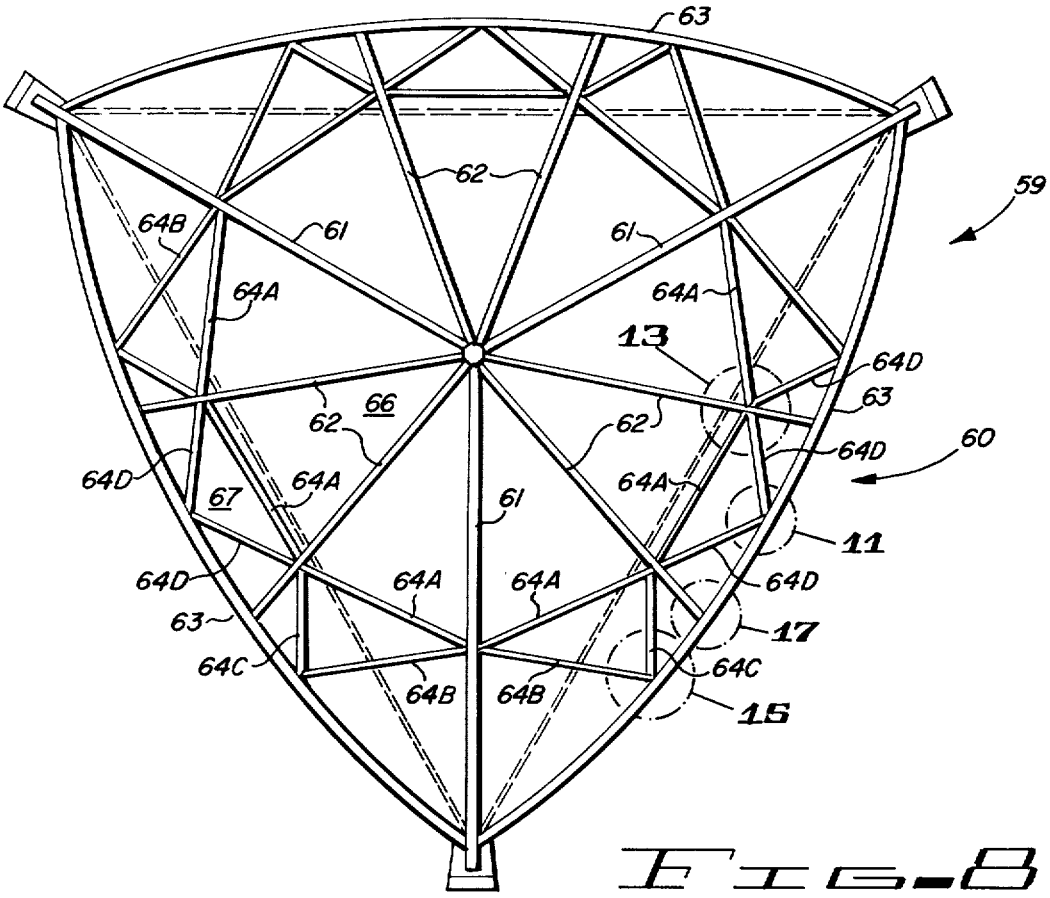
FIG. 8 is a top plan view of a modification of the domical structure shown in FIGS. 1–3.
Figure 9:
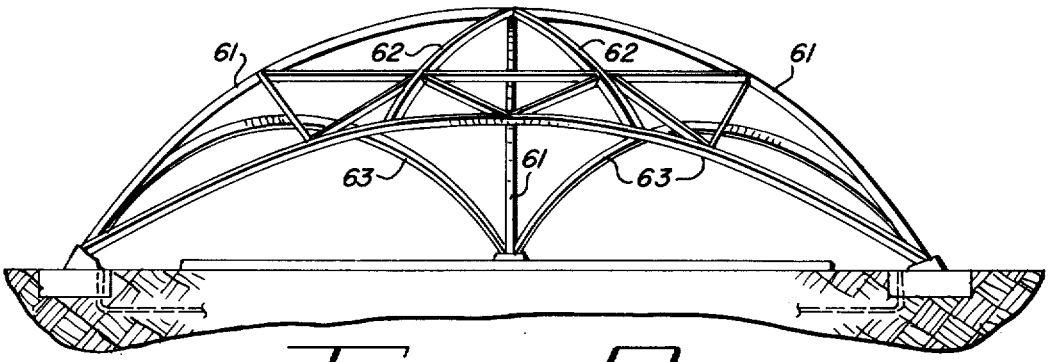
FIG. 9 is a side view of the structure shown in FIG. 8.
Figure 10:
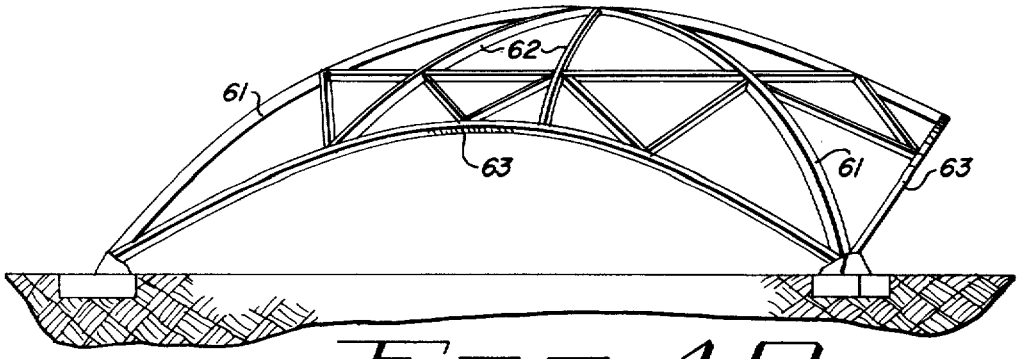
FIG. 10 is a second side view of the structure shown in FIG. 8.

FIGS. 8–10 disclose a modification of the domical structures shown in FIGS. 1–4 wherein the framework is particularly designed for covering by sheathing material which may be curved to form a shell configuration. The strengthening effect of a curved sheathing surface is noted in many natural structures such as eggshells, sea shells and the like. However, it has been difficult to make curved surfacing material artificially.

In the past domical structures have been made of straight members and flat surfaces, as in the geodesic dome or of arches and panels with constant radii of curvature.

The framework 60 disclosed in FIGS. 8–10 permit the use of flat sheathing material laid over openings between arches creating a multiple curved surface giving an esthetically appealing lightweight, strong, low cost, easy to erect and efficient domical structure for use in domestic, commerical and military purposes.

The framework 60 shown in 8–10 utilizes a triangular truss type construction using strong joints between arches and beams. The angles between the arches and beans are laid out to provide an interconnected isosceles triangular pattern with straight beams (when used) forming the bases of the triangle as illustrated. The straight beam acts as a bend zone along which the initially flat roof panel can smoothly change its radius of curvature and yet be fully supported and retain the strength that is inherent in panel sheathing material.

FIGS. 8–10 disclose a domical structure 59 having a framework 60 comprising primary arches 61, secondary arches 62, edge arches 63 and a plurality of tertiary beams 64A, 64B 64C and 64D. In the embodiment shown in FIGS. 8–10, there are three primary arches 61, six secondary arches 62, and three edge arches 63. The arches are arranged about the partial spherical contour of the domical structure 60 as arces of great circles intersecting at the apex of the dome and at the corners of the structure.

The tertiary beams 64A are the bases of isosceles triangles 66 and 67 shown in FIG. 8 where also provide support for the bend zones on the originally flat panels. These tertiary beams may be eliminated if the surface panels are sufficiently stiff so as not to require support along the bend zone.

Figure 11:
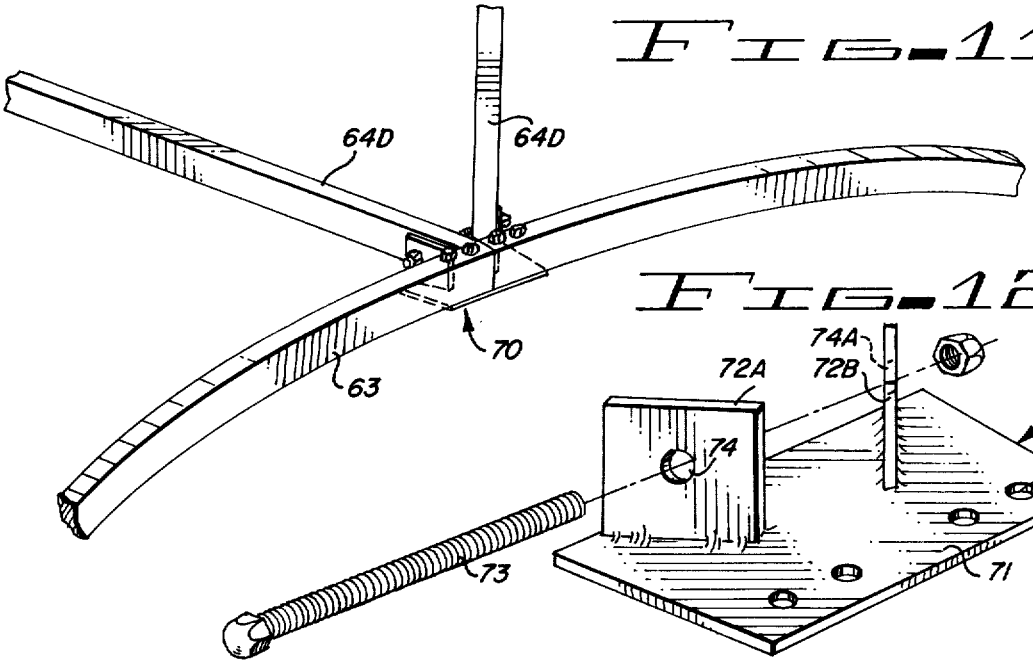
FIG. 11 is an enlarged detailed perspective view of portion 11 shown in FIG. 8 of a support bracket for the interconnection of adjacent edge arches and tertiary beams.
Figure 12:
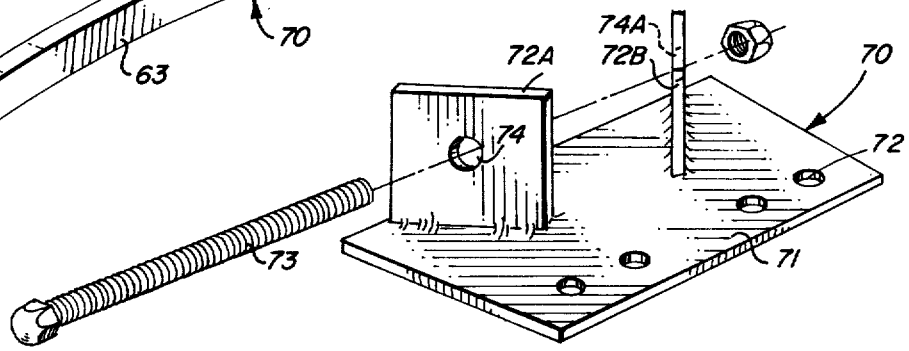
FIG. 12 is an enlarged perspective view of the support bracket shown in FIG. 11.

FIGS. 11 and 12 illustrate an enlarged detailed perspective view of the circled portion 11 shown in FIG. 8 of a support bracket 70 for the interconnection of adjacent edge arches 63 and tertiary beams 64B 64C and 64D. The support bracket 70 comprises a flat plate 71 having a plurality of holes 72 therethrough for aligning with two apertures in each end of the abutting edge arches 63 for receiving suitable nuts and bolts 64 for firmly attaching the edge arches to plate 71. Plate 71 is further provided with a pair of spaced plates 72A, 72B fixedly mounted on their edges on plate 71 and angularly positioned to each other for extending in juxtapositioned arrangement to the sides of the meeting ends of tertiary beams 64B 64C and 64D. A single bolt 73 is arranged to extend through apertures 74, 74A in plates 72A, 72B to clamp the tertiary beams to the support bracket 70.

Figure 13:
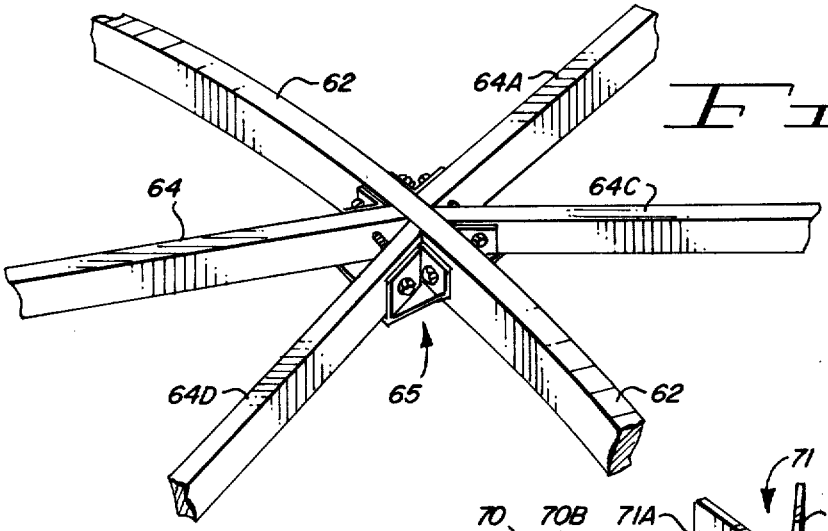
FIG. 13 is an enlarged detailed perspective view of the portion 13 shown in FIG. 11 illustrating the interconnection of the secondary arch with a plurality of tertiary beams.
Figure 14:
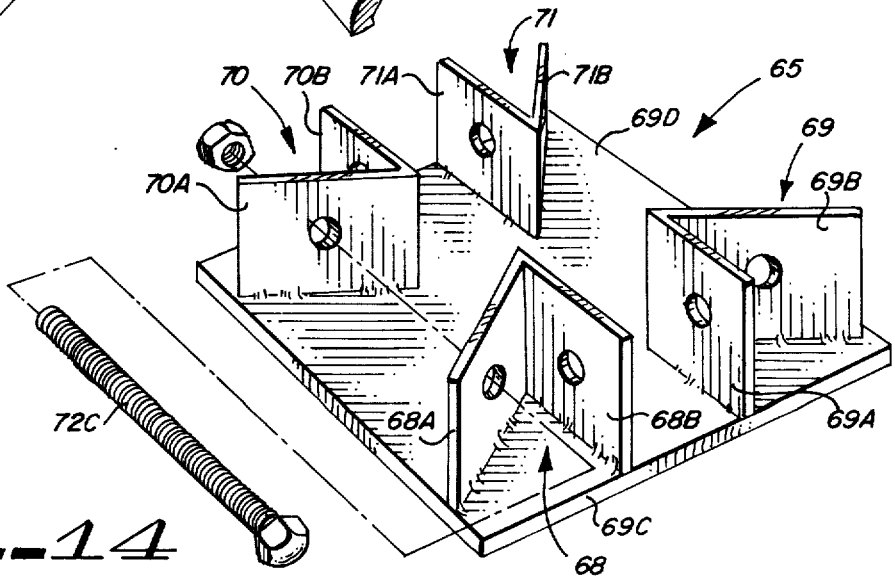
FIG. 14 is an enlarged perspective view of the support bracket shown in FIG. 13.

FIGS. 13 and 14 disclose an enlarged detailed perspective view of the circled portion 13 of FIG. 8 illustrating the interconnection of the secondary arch 62 with tertiary beams 64A, 64D of one portion of the dome structure with tertiary beams 64A and 64B of another portion thereof by a support bracket 65.

The support bracket 65 comprises a flat plate 69C having mounted on edge on its flat top surface 69D four triangularly shaped cleats 68, 69, 70 and 71 each having a pair of apertured plates 68A, 68B, 69A, 69B, 70A, 70B and 71A, 71B fastened together at one edge to form therebetween an acute angle, as shown. As shown, the pairs of plates 68B, 69A and 70B and 71A are positioned in spaced parallel arrangement to each other to lie juxtaposed to the opposite side surfaces of secondary arch 62 in the manner shown in FIG. 13. Plates 68A, 70A, 69B and 71B are positioned to lie juxtaposed to a surface of tertiary beams 64D, 64A, 64C and a second 64A as shown.

This arrangement makes it possible to use one nut and bolt arrangement 72C for clamping two tertiary beams together with another suitable nut and bolt arrangement for clamping the secondary beam 62 to the bracket through the aligned apertures in plates 68B, 69A and 70B, 71A.

Figure 15:
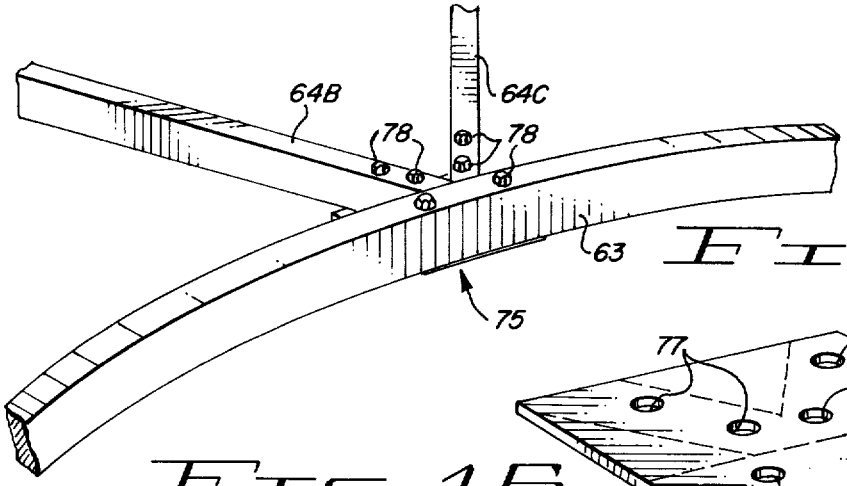
FIG. 15 is an enlarged detailed perspective view of the portion 15 shown in FIG. 11 illustrating the connection of a pair of tertiary beams to a continuous edge arch.
Figure 16:
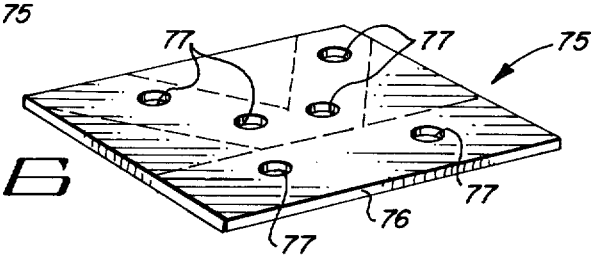
FIG. 16 is an enlarged perspective view of the support bracket shown in FIG. 15.

FIGS. 15 and 16 disclose an enlarged detailed perspective view of the circled portion 15 of FIG. 8 of the connection of a pair of tertiary beams to an edge of edge arch 63 by means of a support bracket 75. This support bracket comprises a flat plate 76 having a plurality of spaced apertures 77 two positioned for aligning with apertures through the edge arch and tertiary beams of the domical structure as shown in FIG. 15 and clamped to the support plate by suitable nut and bolt arrangements 78.

Figure 17:
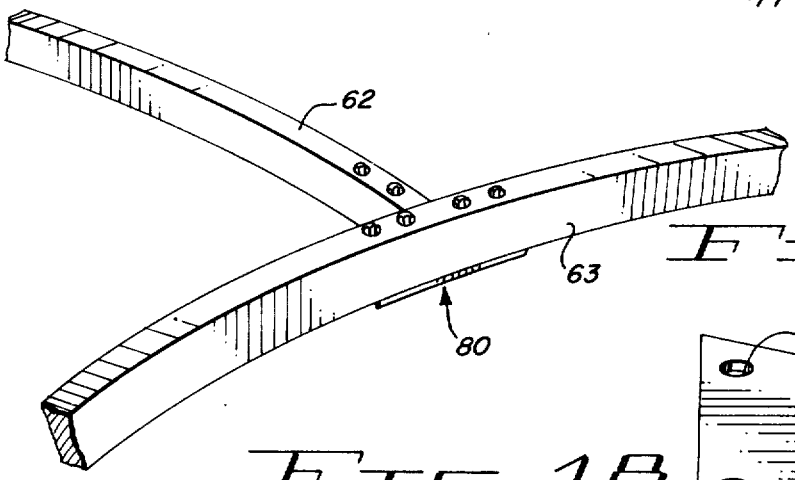
FIG. 17 is an enlarged detailed perspective view of the portion 17 shown in FIG. 11 illustrating the connection of the secondary arch with a continuous edge arch.
Figure 18:
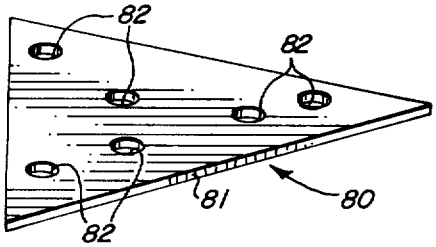
FIG. 18 is an enlarged perspective view of the support bracket shown in FIG. 17.

FIGS. 17 and 18 illustrate an enlargement of the circled portion 17 of FIG. 8 and illustrate the connection of the secondary arch 62 with the edge arch 63 by a support bracket 80. Support bracket 80 comprises a triangular plate 81 having a plurality of apertures 82 extending through in spaced arrangement, such two pairs of the apertures aligning with two pairs of holes extending through the edge arch 63 and one pair of apertures aligning with a pair of holes extending through the end of the secondary arch 62 as shown in FIG. 17. Suitable nut and bolt arrangements are utilized to clamp the secondary beam and the edge arch together.

Figure 19:
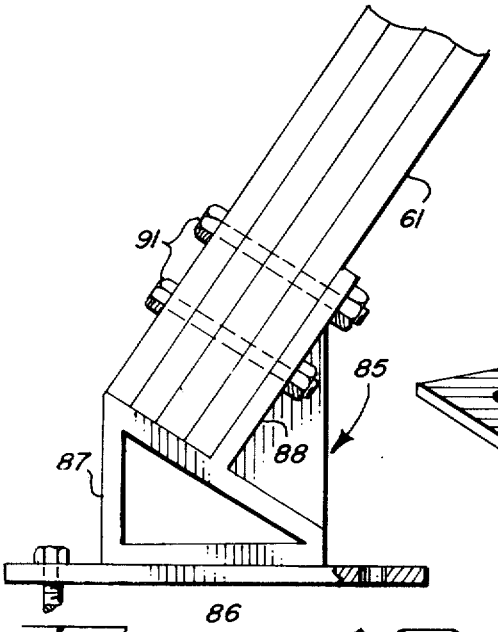
FIG. 19 is a side view of the supporting bracket for clamping the primary arches of the structure shown in FIGS. 1 and 11 to the concrete support bases.
Figure 20:
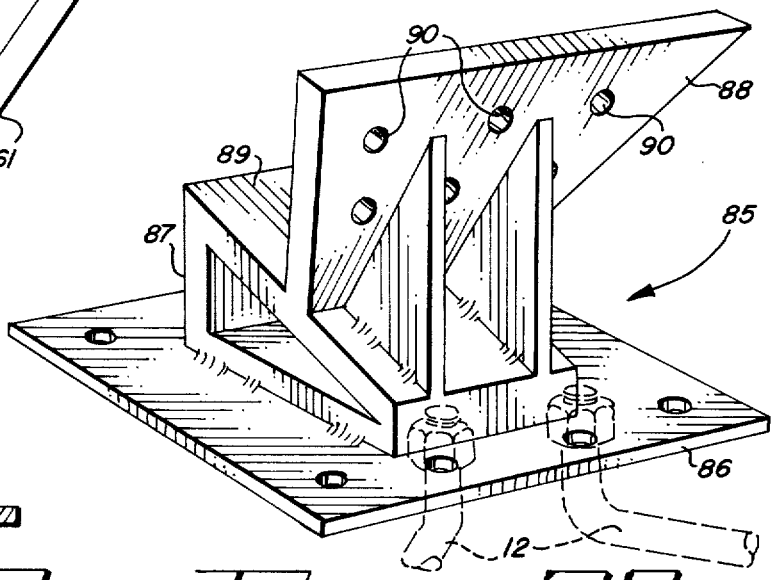
FIG. 20 is an enlarged side perspective view of the support bracket shown in FIG. 19.

FIGS. 19 and 20 illustrate a modification of the support bracket shown in FIG. 5 for clamping the primary arches to the concrete support bases 11 wherein the support bracket 85 comprises a flat rectangular base plate 86, a wedge shaped support member 87 positioned on base plate 86 such that a support plate 88 laterally mounted on surface 89 of the wedge shaped support member 87 extends juxtapositioned to a flat surface of the end of primary arch 61 so that apertures 90 therein aligning with holes extending through the primary arch may receive suitable nut and bolt arrangements 91 as shown in FIG. 19.

Figure 21:
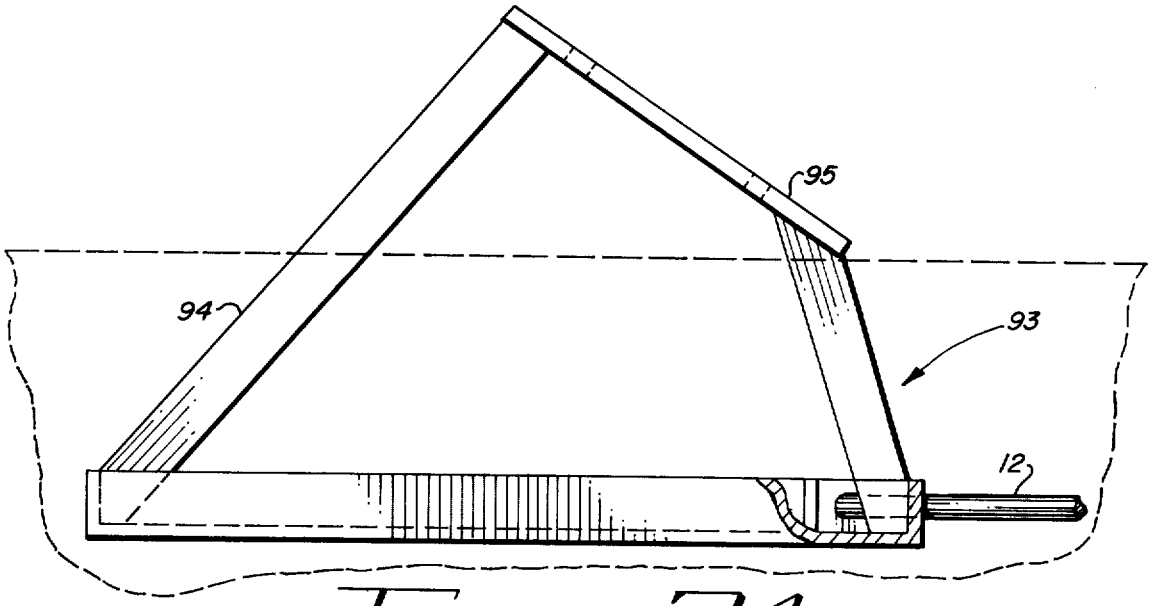
FIG. 21 is a side view partly in section of a further modification of a support bracket for the domical structure shown which may be encased in concrete as part of the support base of the structure.
Figure 22:
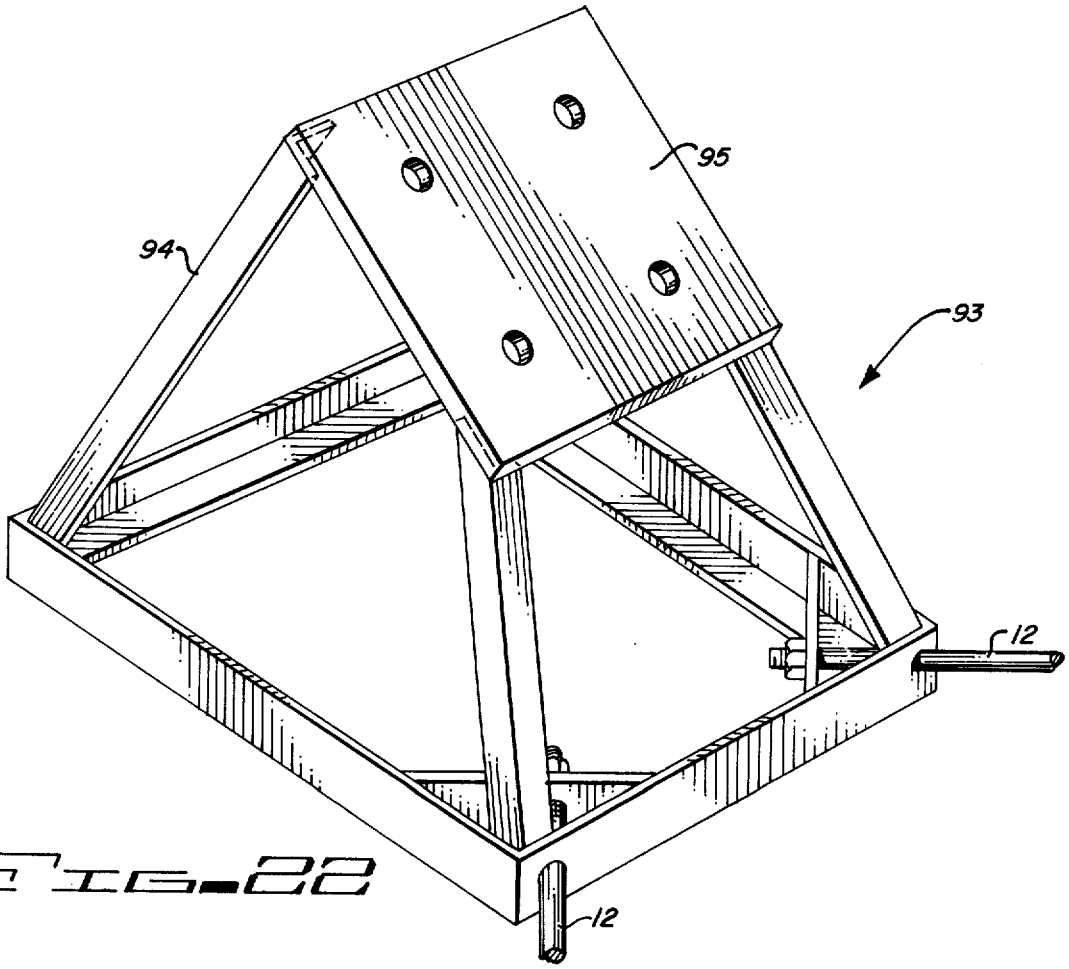
FIG. 22 is an enlarged perspective view of the support bracket shown in FIG. 21 for the domical structure.

FIGS. 21 and 22 illustrate a further modification of the support brackets shown in FIGS. 5, 19 and 20 but differs therefrom by being capable of being encased in the concrete of base 11 if so desired. This support bracket 93 comprises a pier of platform 94 supporting an apertured top plate 95 which is angularly positioned to receive in supporting arrangement the end of the primary beams 14 or 61 for supporting either one of them in the manner of the support bracket 20 shown in FIG. 5. As shown tie rods 12 are arranged for being secured to a part of the platform by suitable means.

It should be noted that the disclosed domical structures may be readily reduced or enlarged in size and serve as a utility building, out building or pool covering with merely an overall reduction or enlargement in size or the parts involved.

Although but a few embodiments of the present invention have been illustrated and described, it will be apparent ot those skilled in the art that various changes and modifications may be made therein without departing from the spirit of the invention or from the scope of the appended claims.

What is claimed is:

1. A domical structure comprising, a plurality of bases, a first plurality of arcuately shaped beams carried on at least one end by said bases and extending therefrom in a substantially vertical plane, a first means for connecting said first beams at the apex of said structure, a plurality of arcuately shaped edge beams having their ends supported by adjacent bases and extending upwardly and outwardly therebetween to define the perimeter of said structure, a second means for firmly attaching said first beams and said edge beams as an integrated structure with each of said bases, said second means comprising a connecting surface attached to and angularly positioned to a reference level within each of said bases, said connecting surface being parallel to and in abutting arrangement with an end surface of said first beam carried by said bases, a second plurality of beams mounted between said first beams to interconnect at one end with said first means at the apex of said structure and forming with said first beams a domical shape, and a third means for connecting the other ends of said second beams and the associated edge beams together, said connecting surface of each of said second means being substantially perpendicular to the line of thrust through the engaging first beam.

2. The domical structure set forth in claim 1 in further combination with;

a fourth means for attaching the ends of associated edge beams at each of said bases to the ends of said first beams carried thereby.

3. The domical structure set forth in claim 2 wherein:

said fourth means attaches the ends of associated edge first beam and beams to each other in axial alignment.

4. The domical structure set forth in claim 1 wherein:

said base comprises a pier of concrete, and said second means comprises a frame encased by the concrete of the pier with the connecting plate extending out of the surface of said pier.

5. The domical structure set forth in claim 1 wherein:

said first means comprises a plate supporting the apical ends of said first beams, said plate being bolted to the ends of each of said first beams.

6. A domical structure comprising, a plurality of bases, a first plurality of arcuately shaped beams carried on at least one end by said bases and extending therefrom in a substantially vertical plane, a first means for connecting said first beams at the apex of said structure, a plurality of arcuately shaped edge beams attached to and extending upwardly and outwardly between said first beams to define the perimeter of said structure, a second means for firmly attaching said first beams as an integrated structure with each of said bases, said second means comprising a connecting surface attached to and angularly positioned to a reference level within each of said bases, said connecting surface being parallel to and in abutting arrangement with an end surface of said first beam carried by said bases, a second plurality of beams mounted between said first beams to interconnect at one end with said first means at the apex of said structure and forming with said first beams a domical shape, and a third means for connecting the other ends of said second beams and the associated edge beams together, said connecting surface of each of said second means being substantially perpendicular to the line of thrust through the engaging first beam.

* * * * *

UNITED STATES PATENT OFFICE

CERTIFICATE OF CORRECTION

Patent No. 3,950,901 Dated 4-20-76

Inventor(s) John S. Sumner

It is certified that error appears in the above-identified patent and that said Letters Patent are hereby corrected as shown below:

Column 9, line 33, before "to", cancel "edge first beam and beams" and substitute ---first beam and edge beams---.

Signed and Sealed this

Ninth Day of November 1976

[SEAL]

*Attest:*

RUTH C. MASON
*Attesting Officer*

C. MARSHALL DANN
*Commissioner of Patents and Trademarks*